US007762912B2

(12) United States Patent
Lewis

(10) Patent No.: US 7,762,912 B2
(45) Date of Patent: Jul. 27, 2010

(54) METHOD AND APPARATUS FOR PRACTICING PITCHING A BASEBALL

(75) Inventor: H. Kenneth Lewis, Phoenix, AZ (US)

(73) Assignee: Zonein Sports, LLC, Tempe, AZ (US)

( * ) Notice: Subject to any disclaimer, the term of this patent is extended or adjusted under 35 U.S.C. 154(b) by 30 days.

(21) Appl. No.: 11/039,216

(22) Filed: Jan. 19, 2005

(65) Prior Publication Data

US 2005/0288129 A1 Dec. 29, 2005

(51) Int. Cl.
*A63B 69/00* (2006.01)

(52) U.S. Cl. ..... 473/454; 473/422

(58) Field of Classification Search ..... 473/422, 473/434, 451, 454–456; 273/348, 407, 402
See application file for complete search history.

(56) References Cited

U.S. PATENT DOCUMENTS

| | | | | | |
|---|---|---|---|---|---|
| 1,511,430 | A * | 10/1924 | Schonberg | 473/454 |
| 3,312,467 | A * | 4/1967 | Dawson | 473/454 |
| 3,583,703 | A * | 6/1971 | Brown et al. | 473/456 |
| 4,173,337 | A * | 11/1979 | Okonowski | 473/456 |
| 4,210,326 | A * | 7/1980 | Booth et al. | 473/454 |
| 4,254,952 | A * | 3/1981 | Playter, Jr. | 473/456 |
| 4,333,646 | A * | 6/1982 | Pfeilsticker | 473/435 |
| 4,415,154 | A * | 11/1983 | Engelhardt | 473/456 |
| 4,473,227 | A * | 9/1984 | Klaus | 473/454 |
| 4,643,423 | A * | 2/1987 | Wright | 473/456 |
| 4,657,250 | A * | 4/1987 | Newland et al. | 473/432 |
| 5,333,855 | A * | 8/1994 | Silin et al. | 473/455 |
| 5,333,856 | A * | 8/1994 | Gery | 473/454 |
| 5,348,291 | A * | 9/1994 | Scully | 473/454 |
| 5,573,240 | A * | 11/1996 | Humboldt | 473/454 |
| D479,295 | S * | 9/2003 | Vesledahl | D21/780 |
| 6,837,809 | B2 * | 1/2005 | Majumdar | 473/454 |
| 6,878,078 | B2 * | 4/2005 | Swanson | 473/454 |
| 2002/0049103 | A1 * | 4/2002 | Treihart | 473/454 |

* cited by examiner

*Primary Examiner*—Mitra Aryanpour
(74) *Attorney, Agent, or Firm*—Tod R. Nissle, P.C.

(57) ABSTRACT

An apparatus and method are provided for practicing pitching a baseball. The apparatus can be configured to receive pitches thrown into a specific designated area of the strike zone and to reject pitches not thrown to the specific designated area. The apparatus alters the position of the strike zone to compensate for the positioning of a catcher behind home plate. The apparatus more accurately identifies the strike zone, and areas outside the strike zone, to which a pitcher should practice throwing pitches.

2 Claims, 10 Drawing Sheets

19
14
10
20
18
11
21
12
13
16
22
17
A
15
33
C
35
D
36
E
37
B
80
32
31
34
30

METHOD AND APPARATUS FOR PRACTICING PITCHING A BASEBALL

CROSS-REFERENCE TO RELATED APPLICATIONS

N/A

STATEMENT REGARDING FEDERALLY SPONSORED RESEARCH OR DEVELOPMENT

N/A.

THE NAMES OF PARTIES TO A JOINT RESEARCH OR DEVELOPMENT

N/A.

INCORPORATION-BY-REFERENCE OF MATERIAL SUBMITTED ON A COMPACT DISC

N/A.

BACKGROUND OF THE INVENTION (1) Field of the Invention

This invention pertains to a method and apparatus for practicing sports.

More particularly, the invention pertains to a method and apparatus for practicing pitching a baseball.

(2) Description of Related Art Including Information Disclosed Under 37 CFR 1.97 and 1.98.

One well known apparatus for practicing pitching a baseball is known as the "CANVAS CATCHER" and consists of an upright frame with a piece of canvas mounted on the frame. A single opening is formed in the canvas. The width of the opening is generally equivalent to the width of a regulation home plate. A pitcher practices by throwing a ball into the opening. This device has been available and successfully marketed for many years and apparently exemplifies conventional wisdom that pitchers should practice by throwing a baseball over home plate into an opening having a width comparable to home plate.

The width of a regulation home plate is seventeen inches. The diameter of a regulation "hardball" baseball is about three inches. A ball thrown over a regulation home plate is, according to the rules of baseball, called a strike if any portion of the ball is over the plate. This rule has the effect of making the strike zone equal to about twenty-three inches. Accordingly, pitching devices having an opening that has a width equal to about seventeen inches do not accurately represent the strike zone according to the rules of baseball, and do not enable a pitcher to practice throwing a baseball over areas that are inside and outside the outer edges of home plate and that still qualify as a strike because a portion of the ball passes over home plate.

Accordingly, it would be highly desirable to provide an improved pitching device that accurately reflects the strike zone according to the rules of baseball and that enables a baseball pitcher to practice throwing a baseball in selected areas of such a strike zone.

Therefore, it is a principal object of the invention to provide improved apparatus for practicing sports.

A further object of the invention is to provide an improved apparatus for practicing pitching a baseball.

Another object of the invention is to provide an improved pitching practice apparatus that enables a pitcher to practice pitching by throwing a baseball to areas outside of the strike zone.

Still a further object of the invention is to provide an improved pitching practice apparatus that enables a pitcher to readily identify and throw to specific areas in the strike zone.

These and other, further and more specific objects and advantages of the invention will be apparent from the following detailed description of the invention, taken in conjunction with the drawings, in which:

BRIEF SUMMARY OF THE INVENTION

Figure 1:
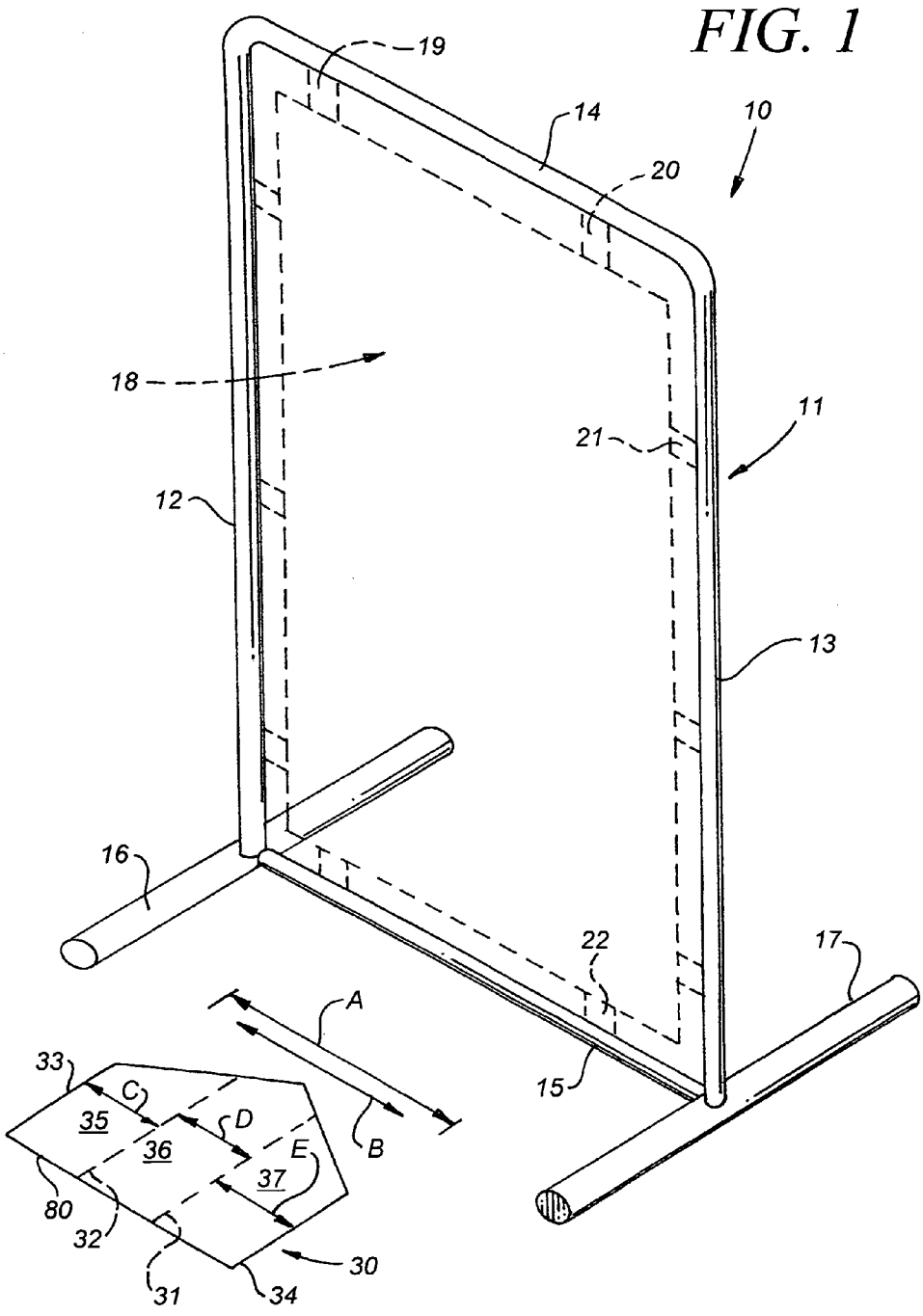
FIG. 1 is a perspective view illustrating a frame and strike zone indicator utilized in the pitching practice apparatus of the invention.

Briefly, in accordance with my invention, I provide an improved method for practicing pitching a baseball. The method includes the step of providing apparatus comprising an upright support; a strike zone parsing unit mounted on the support and including at least two target openings collectively defining a virtual strike zone that has an effective width that is greater than the width of a regulation home plate; and, a shielding system for covering least a portion of at least one of said openings. The method also includes the steps of selecting a first target area consisting of at least a portion of one of the target openings; throwing pitches toward the first target area; selecting a second target area different from the first target area; using the shielding system to cover at least a portion of one of the target openings while leaving the second target area open. The apparatus can include a plate with a plurality of strike zones each in registration with one of the target openings. The method can include throwing pitches over a strikes zone in registration with the selected target area.

In another embodiment of the invention, I provide an improved strike zone parsing display marked to define at least three separate strike zone areas including a first area shaped and dimensioned to correspond to an area extending through a center portion of a primary area defined by a regulation home plate; a second area shaped and dimensioned to correspond to a first initial area corresponding to a portion of the primary area to one side of the center portion, and to an auxiliary area corresponding to an area outside the primary area and adjacent the first initial area; a third area extending laterally away from the first area and the second area and shaped and dimensioned to correspond to a second initial area corresponding to a portion of the primary area to another side of the first area, and to a second auxiliary area corresponding to an area outside the primary area and adjacent the second initial area.

In a further embodiment of the invention, I provide an improved method for practicing pitching a baseball. The method includes the step of providing apparatus comprising an upright support; a strike zone parsing unit mounted on the support and including at least one target opening defining a virtual strike zone that has an effective width that is greater than the width of a regulation home plate; and, a shielding system for covering least a portion of the opening. The method also includes the steps of selecting a first target area consisting of at least a portion of the target opening; throwing pitches toward the first target area; selecting a second target area different from the first target area; and, using the shielding system to cover at least a portion of the target opening while leaving the second target area open.

In still another embodiment of the invention, I provide improved apparatus for an individual to practice throwing to different locations over a regulation home plate having a width and a peripheral edge. The apparatus includes an upright support; and, a strike zone parsing unit mounted on the support and including at least two separate target openings collectively defining a virtual strike zone that has an effective width that is greater than the width of the regulation home plate. The apparatus can include a system to reduce the size of the target opening. The apparatus can include a horizontally oriented plate including a centerline and positioned in front of and normal to the strike zone parsing unit. The apparatus can include a strike zone parsing plate having a width; a peripheral edge; a primary area circumscribed by the peripheral edge; and, three separate marked strike zone areas. The strike zone areas include a first area shaped and dimensioned to correspond to an area extending through a center portion in the primary area; a second area shaped and dimensioned to correspond to a first initial area corresponding to a portion of the primary area to one side of the center portion, and to an auxiliary area corresponding to an area outside the primary area and adjacent the first initial area; and, a third area extending laterally away from the first area and the second area and shaped and dimensioned to correspond to a second initial area corresponding to a portion of the primary area to another side of the first area, and to a second auxiliary area corresponding to an area outside the primary area and adjacent the second initial area. Each of at least two of the strike zones are in registration with a separate one of the target openings.

DETAILED DESCRIPTION OF THE INVENTION

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates the pitching practice apparatus of the invention generally indicated by reference character 10. Apparatus 10 includes an upright support 11 including interconnected sides 12 and 13, top 14, bottom 15, and feet 16 and 17. Feet 16 and 17 rest on the ground, on a floor, or on another desired horizontally oriented support surface. A strike zone parsing unit is mounted on support 11 and indicated by dashed lines 18. Straps 19 to 22 or any other desired support means removably or permanently secures parsing unit 18 to support 11.

Horizontally oriented strike zone parsing plate 30 is placed in front of unit 18 on the ground or on another horizontally oriented support surface. Plate 30 can have any desired shape and dimension and configuration, including the shape and dimension of a conventional baseball home plate, but presently has a shape in which the width of plate 30, indicated by arrows A, is greater than the seventeen inch width, indicated in FIG. 1 by arrow B, of a conventional home plate. In addition, plate 30 includes parse or strike zone areas 35, 36, 37.

Area 36 lies intermediate dashed lines 31 and 32. Area 35 lies intermediate dashed line 32 and the side 33 of plate 30. Area 37 lies intermediate dashed line 31 and side 34 of plate 30.

Areas 35 to 37 are each preferably readily visually discernible and distinguishable one-from-the-other to a viewer. In the presently preferred embodiment of the invention, such is achieved by coloring area 35 red, area 36 white, and area 37 blue. Any other desired color schemes and/or markings or shaping or dimensioning can be utilized to enable one area 35, 36, 37 to be readily visually discerned and distinguished with respect to each of the remaining areas 35 to 37.

Figure 2:
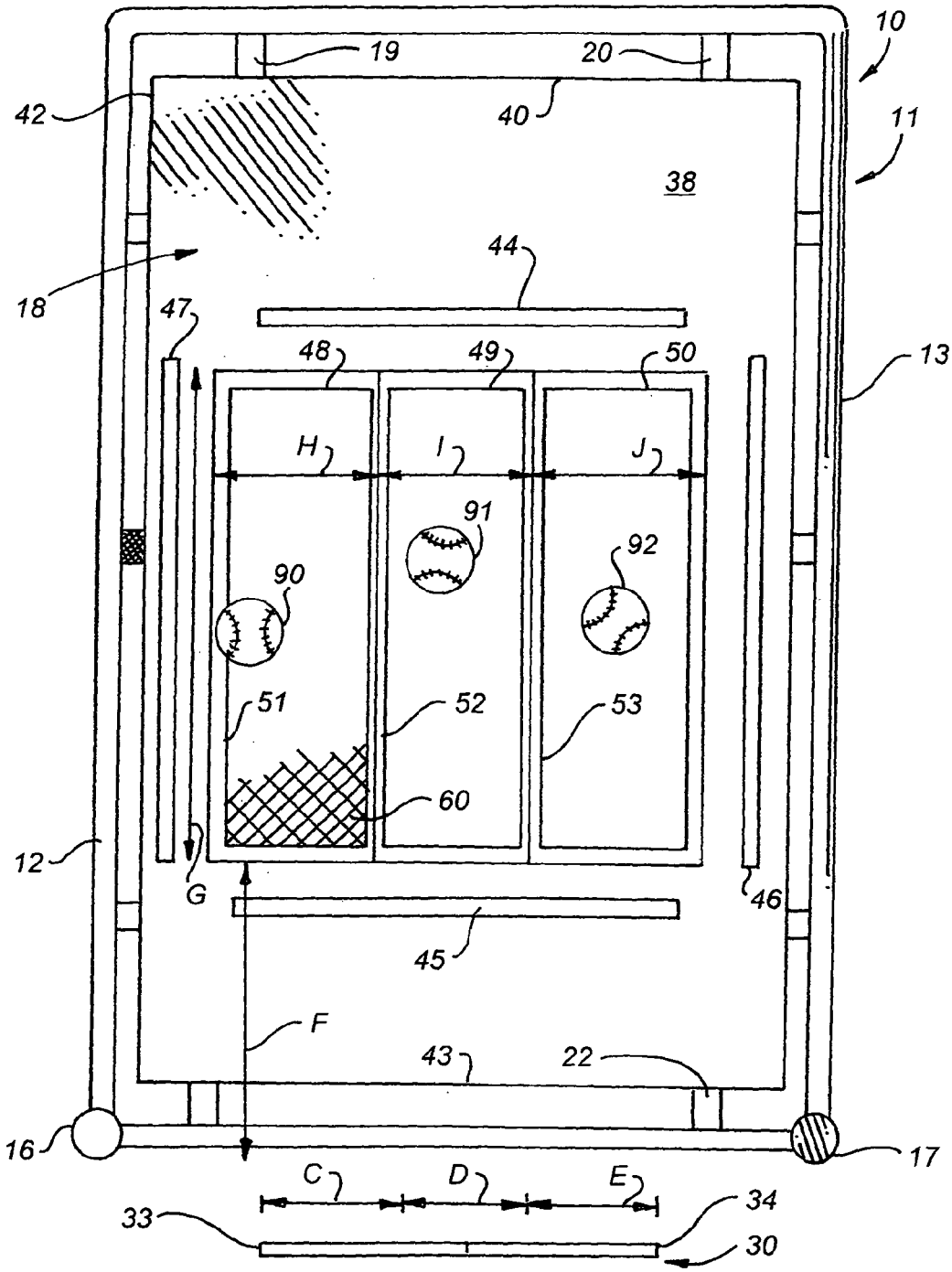
FIG. 2 is a front view illustrating the frame and strike zone indicator of FIG. 1 and also illustrating the strike zone parsing unit housed in the frame.

Strike zone parsing unit 18 is illustrated in greater detail in FIG. 2 and includes hook and/or loop VELCRO fastening strips 44 to 47 each fixedly secured to a panel 38 of material. Panel 38 can be rigid or semi-rigid. If panel 38 is rigid or semi-rigid, panel 38 may be propped against a vertically oriented support surface or panel 38 may have feet or some other support system and upright support 11 may not be necessary in the practice of the invention.

Panel 38 is presently preferably, however, fabricated from canvas, from a thick polymer, or from some other pliable material that flexes or elastically stretches or at least partially deforms or gives when a baseball is thrown against panel 38.

One or more openings 48, 49, 50 is formed through panel 38. Each opening is preferably, but not necessarily, provided with a netting 60 or other assembly that is attached to the rear of panel 38 and of the opening, and that catches and stores balls that are thrown toward the front of panel 38 and that pass through an opening 48 to 50. The front of panel 38 is shown in FIGS. 2 to 5.

Each opening 48 to 50 is, if desired, be provided with an edging or border 51 to 53, respectively. Each border 51 to 53 is preferably visually discernible and distinguishable with respect to the remaining borders 51 to 53. In the presently preferred embodiment of the invention, such is achieved by coloring border 51 red, border 52 white, and border 53 blue. Any other desired color schemes and/or markings or shaping or dimensioning can be utilized to enable one area 51 to 53 to be readily visually discerned and distinguished with respect to each of the remaining areas 51 to 53.

The width, indicated by arrows H and I and J, of an opening (including the border around the opening), can vary as desired, but presently is in the range of six to nine inches. The sum of the widths H to J can also vary as desired, but presently is in the range of eighteen to twenty-eight inches, preferably twenty to twenty-six inches, most preferably twenty-three to twenty-five inches.

Alternatively, the width of each opening 48, 49, 50 (not including the width of the accompanying borders 51 to 53) can vary as desired, but presently is in the range of five to ten inches. The sum of the widths of openings 48, 49, 50 (not including the widths of the accompanying borders 51 to 53) can vary as desired, but presently is in the range of eighteen to twenty-eight inches, preferably twenty to twenty-six inches, most preferably twenty-three to twenty-five inches.

The height, indicated by arrows F, of the bottom of each opening 48 to 50 above the ground can vary as desired, as can the height, indicated by arrows G, from the bottom to the top of each opening 48 to 50.

In one configuration of the apparatus of the invention, the height F is about equal within plus or minus six inches to the height above the ground of the knees of a hitter of average height and physical build, and, the height G is equal within plus or minus six inches to the distance from the knees to the center of the chest of a hitter of average height and physical build. In other words, height G is about equal to the height of the normal strike zone in the game of baseball for a player of average height and physical build. The height G is currently thirty-two inches.

In another preferred configuration of the apparatus of the invention, the height F is about equal (i.e., equal to within plus or minus one-half inch) to one to eight inches, preferably three to five inches, most preferably four inches, less than the height above the ground of the knees of a hitter of average height and physical build, and, the height G, is about equal (i.e., equal to within plus or minus one-half inch) to one to eight inches, preferably three to five inches, most preferably four inches, less than the distance from the knees to the center of the chest of a hitter of average height and physical build. This preferred configuration is advantageously utilized when the apparatus of the invention is positioned a distance behind home plate at a location that generally corresponds to the distance behind home plate at which a catcher positions his glove to receive a pitch from a pitcher. When the apparatus of the invention is so positioned behind home plate, the preferred configuration is important because it more accurately represents the strike zone utilized by a pitcher for most pitches. The preferred configuration is believed to more accurately represent the strike zone because the pitcher tends to throw many pitches that travel along a line that is canted, or downwardly tilted, from the pitcher's mound to home plate. This is the case in part because the top of the pitcher's mound is at a higher elevation than home plate, and in part because the location of the pitcher's hand when the ball is released often is at a higher elevation than the elevation of the ball when the ball crosses home plate. Consequently, since the ball travels along a downwardly tilted line, or path, from the pitcher's mound to home plate, the ball will, when it reaches the catcher's glove, be at a lower elevation than that ball is when it crosses home plate on its way to the catcher's glove. In addition, some pitches "break" downwardly when they reach the vicinity of home plate. Therefore, reducing the heights F and G to positions below the normal "knee-to-mid-chest" strike zone is believed to be important in training a pitcher to throw a baseball in the desired strike zone. In the preferred configuration the height F is currently eight and one-half inches and the height G is currently thirty-two inches.

As is illustrated in FIGS. 1 and 2, strike parsing plate 30 is placed in front of unit 18 such that when plate 30 and unit 18 are viewed from the front as is depicted in FIG. 2, area 35 appears below and centered on and thus in registration with opening 48; such that area 36 appears below and centered on and thus in registration with opening 49; and, such that area 37 appears below and centered on and thus in registration with opening 50. Plate 30 is preferably, although not necessarily, spaced a distance in from of unit 18 that is about equivalent to the distance between home plate and the mitt of a catcher positioned behind home plate, i.e., practice apparatus 10 is positioned such that unit 18 is at the position of the mitt of a catcher waiting to receive a pitch. The width C of area 35 can vary as desired but is typically equivalent to width H or to the width of opening 48, i.e. is equal to or within plus or minus two inches of the width H or the width of opening 48. The width D of area 36 can vary as desired but is typically equivalent to width I or to the width of opening 49, i.e. is equal to or within plus or minus two inches of the width I or the width of opening 49. The width E of area 37 can vary as desired but is typically equivalent to width J or to the width of opening 50, i.e. is equal to or within plus or minus two inches of the width J or the opening 50.

Opening 50 corresponds to an area of the strike zone that is on the inside of home plate. A baseball 92 that is thrown at and enters opening 50 travels over area 37. In FIG. 2, baseball 92 is depicted after it has passed over area 37 and at the moment it is entering opening 50. Opening 49 corresponds to an area of the strike zone that is in the center of home plate. A baseball 91 that is thrown at and enters opening 49 travels over area 36. In FIG. 2, baseball 91 is depicted after it has passed over area 36 and at the moment it is entering opening 49. Opening 48 corresponds to an area of the strike zone that is on the outside of home plate. A baseball 90 that is thrown at and enters opening 48 travels over area 35. In FIG. 2, baseball 90 is depicted after it has passed over area 35 and at the moment it is entering opening 48. When panel 38 is fabricated from canvas or another material with some give, a ball 90 usually will still travel into an opening 48 even when an outer portion of the ball contacts a border 51, provided the majority of the ball is, as is the case in FIG. 2, positioned to travel through opening 48.

Figure 3:
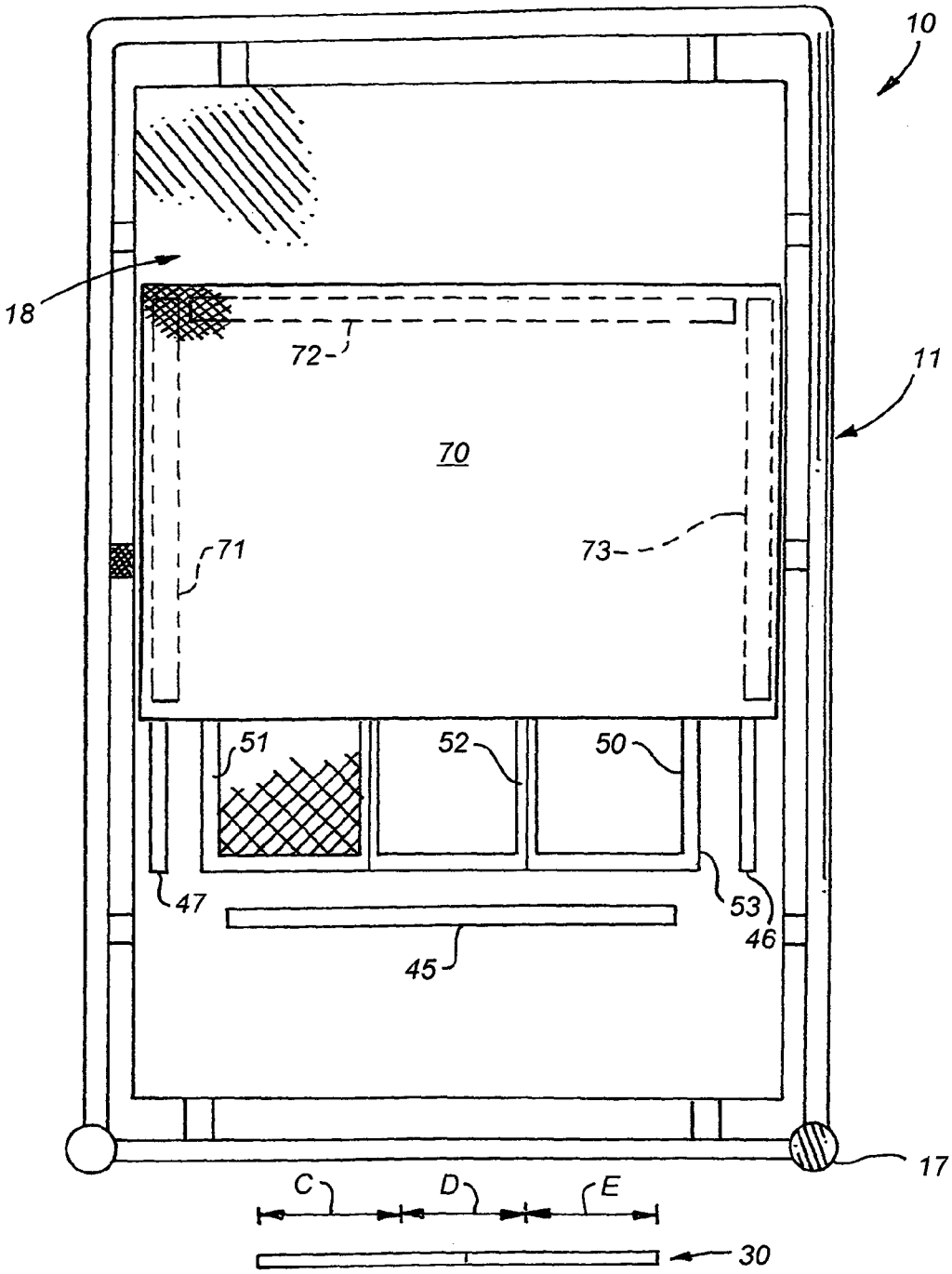
FIG. 3 is a front view illustrating the pitching practice apparatus of FIG. 2 with a sheet material installed thereon to cover a portion of the target area(s) in the strike zone parsing unit.

In FIG. 3, an auxiliary panel 70 of canvas, polymer, or other material is placed on unit 18 to cover a portion of each opening 48 to 50. Strips 71 to 73 of VELCRO fastening material are permanently secured to the back of panel 70. Each strip 71 to 73 removably attaches to at least a portion of an opposing strip 47, 44, 46, respectively, on unit 18.

Figure 4:
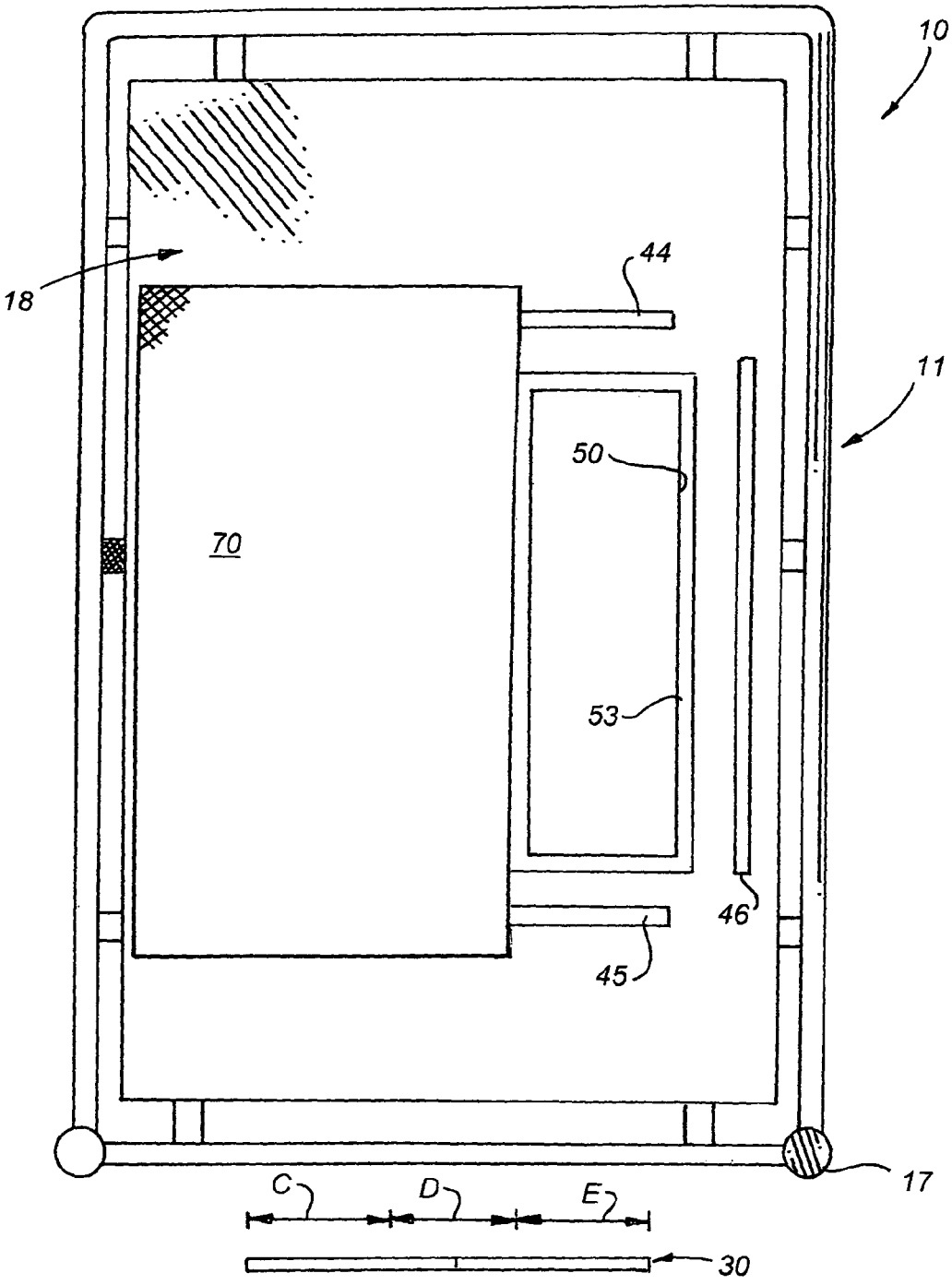
FIG. 4 is a front view illustrating the pitching practice apparatus of FIG. 2 with the sheet material of FIG. 3 installed thereon in an alternate orientation to cover a different portion of the target area in the strike zone parsing unit.

FIG. 4 illustrates another orientation in which panel 70 is mounted on unit 18 to cover openings 48 and 49. In FIG. 4, strips 71 to 73 are each removably secured to at least a portion of an opposing strip 45, 47, 44, respectively.

Figure 5:
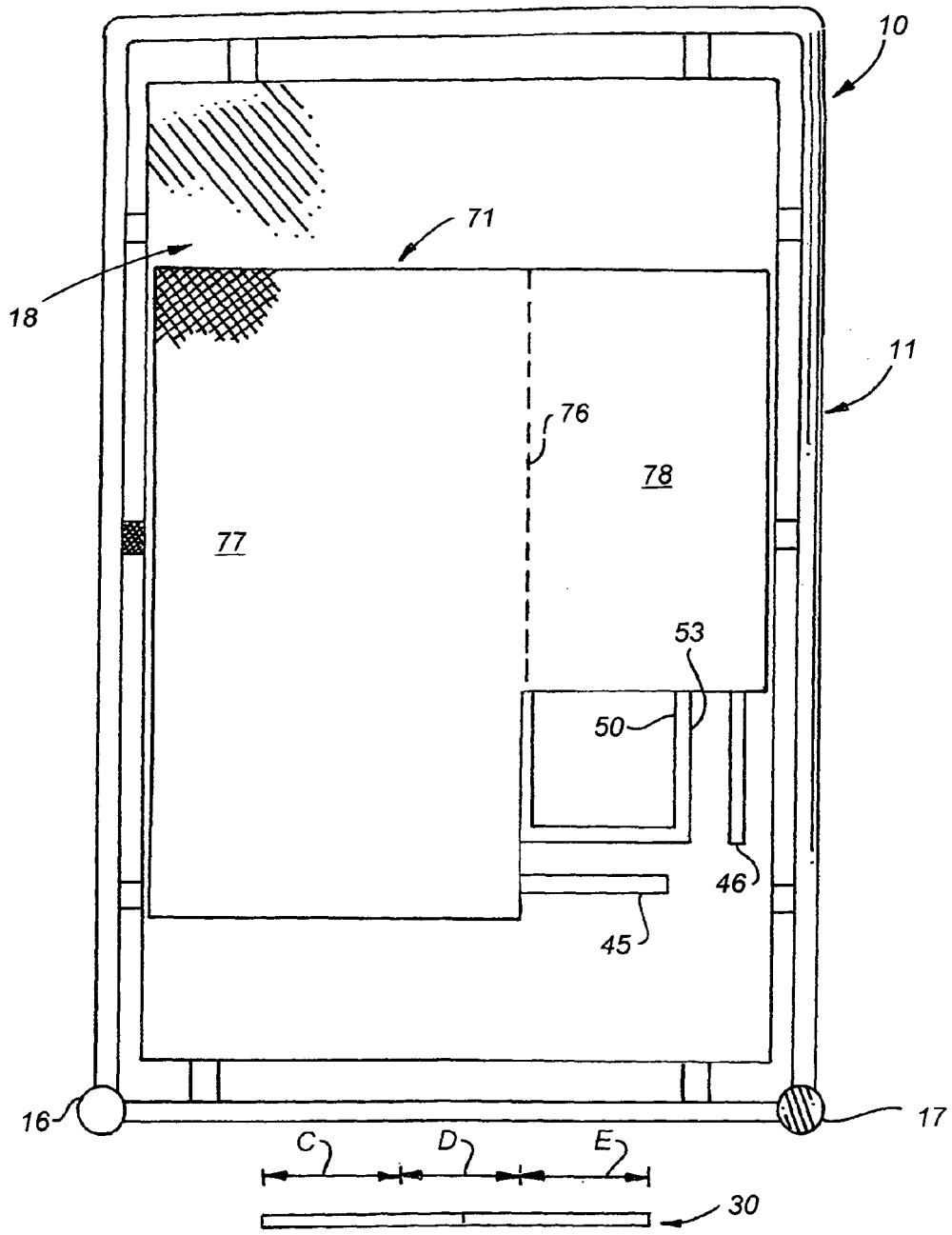
FIG. 5 is a front view illustrating the pitching practice apparatus of FIG. 2 with a sheet material of different shape and dimension installed thereon to cover still a different portion of the target area in the strike zone parsing unit.

FIG. 5 illustrates a pliable panel 71 removably secured to unit 18. Panel 71 has a configuration different than that of panel 70 such that panel 71 leaves only a portion of opening 50 uncovered. As indicated by dashed line 76, portion 78 of panel 71 can be folded along dashed line 76 over onto portion 77 such that the entire opening 50 is uncovered. Or, portion 77 can be folded along line 76 over onto portion 78 such that openings 48 and 49 are uncovered and opening 50 is completely covered. Any desired number of panels 70 and 71 of any desired shape and dimension and configuration can be utilized to cover selected portions of an opening(s) 48 to 50 so that the size of the exposed portions of opening(s) 48 to 50 is reduced and requires a pitcher to exercise a greater degree of control and accuracy to consistently repeatedly throw a pitch into the exposed portions.

Figure 6:
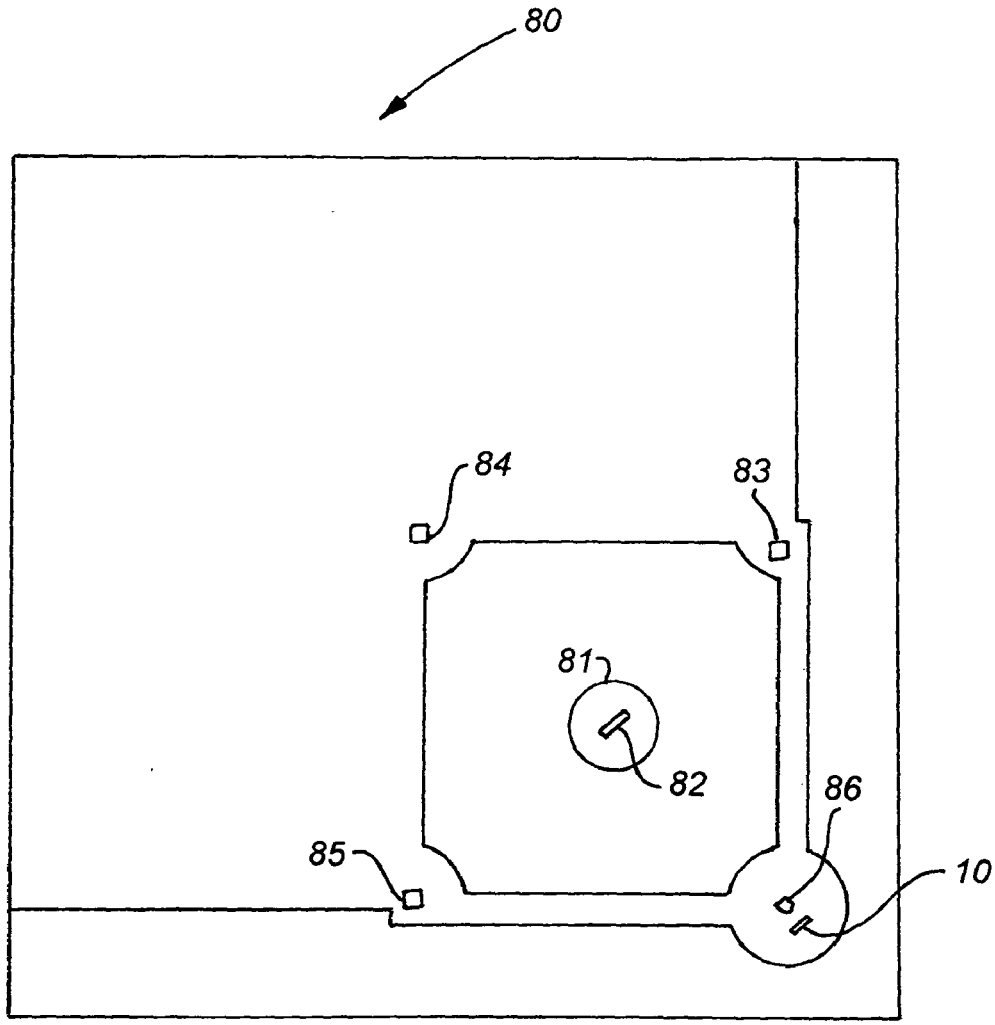
FIG. 6 is a top view of a conventional baseball field illustrating the mode of operation of the pitching practice apparatus of the invention; and, FIGS. 7 to 10 illustrate the mode of operation of the shielding panel of the invention.

FIG. 6 illustrates a conventional baseball field including home plate 86, pitcher's mound 81, pitching rubber 82, first base 83, second base 84, and third base 85.

In use of practice apparatus 10, apparatus 10 of FIG. 2 is positioned behind home plate 86 at a location that places the front or face of unit 18 (which front is visible in FIG. 2) at a location that approximates the distance of a catcher's mitt behind home plate when a catcher is ready to receive a pitch from a baseball pitcher. A panel 70, 71 is, if desired, utilized to cover portions of openings 48 to 50. A pitcher takes his normal position on mound 81 astride or adjacent rubber 82; selects a particular opening 48 to 50 or, more preferably, a more specific selected target location in an opening 48 to 50 (i.e., the top, middle, or bottom of an opening 48 to 50) at which to throw a pitch; and, imagines that a catchers glove is at the selected target location. The pitcher fixes his eyes on the selected location, relaxes by inhaling and exhaling, blocks out extraneous noises or thoughts, concentrates on watching the selected target location, and throws a pitch at the selected target location in unit 18. If the pitch passes through an opening 48 to 50, the pitch is captured in netting 60 behind the opening. If the pitch misses all three openings 48 to 50 and strikes panel 38, the ball typically bounces off panel 38 in a direction generally toward plate 30. If the ball completely misses apparatus 10, it sails past and rolls along the ground or impacts a backstop or some other object that is behind apparatus 10. The pitcher repeats the foregoing process as many times as desired and, if the pitcher wishes, uses a panel 90, 91 to cover portions of opening(s) 48 to 50 to change the location of or reduce the size of the target location the pitcher selects.

One advantage of apparatus 10 is that it can be utilized at locations other than a full blown baseball field, and can be used with or without a pitcher's mound. Portable pitcher's mounds are available that can be readily set up so that apparatus 10 can be utilized at a park or any other location that has sufficient space for a portable pitcher's mound and for apparatus 10 positioned a selected distance (typically about 62 feet) from the front edge (edge closest to home plate) of the pitcher's rubber 82 on the pitcher's mound. The front edge 80 of parsing plate 30 or of a conventional home plate is positioned sixty feet and six inches from the front edge of pitching rubber 82.

In addition to being used to practice pitching a baseball, the apparatus 10 can be utilized in conjunction with other sports. By way of example, and not limitation, apparatus 10 can be utilized to practice pitching a softball into one or more openings 48, 49, 50 of desired shape and dimension, to practice chipping a golf ball into one or more openings 48, 49, 50 of desired shape and dimension, and so on.

Apparatus 10 can also be used by baseball players other than pitchers to practice throwing a baseball. The apparatus 10 can, for example, be placed at second base facing home plate and a catcher can practice throwing from home plate to second base by attempting to throw the ball from home plate into one of openings 48, 49, 50. Or, the apparatus 10 can be placed at second base facing first base and a first baseman can practice throwing from first base to second base by attempting to throw the ball from first base into one of openings 48, 49, 50. And so on.

Figure 7:
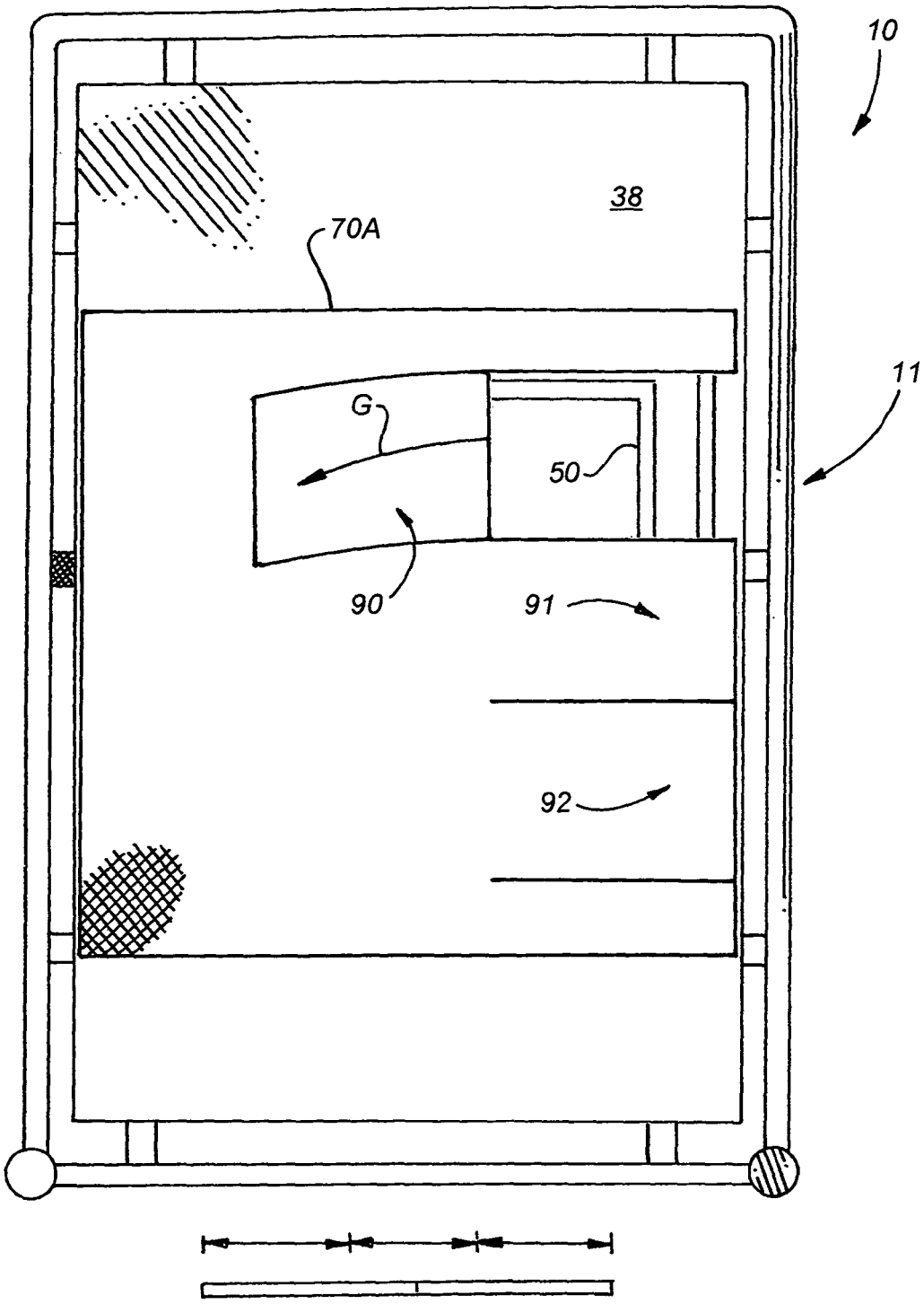
Figure 8:
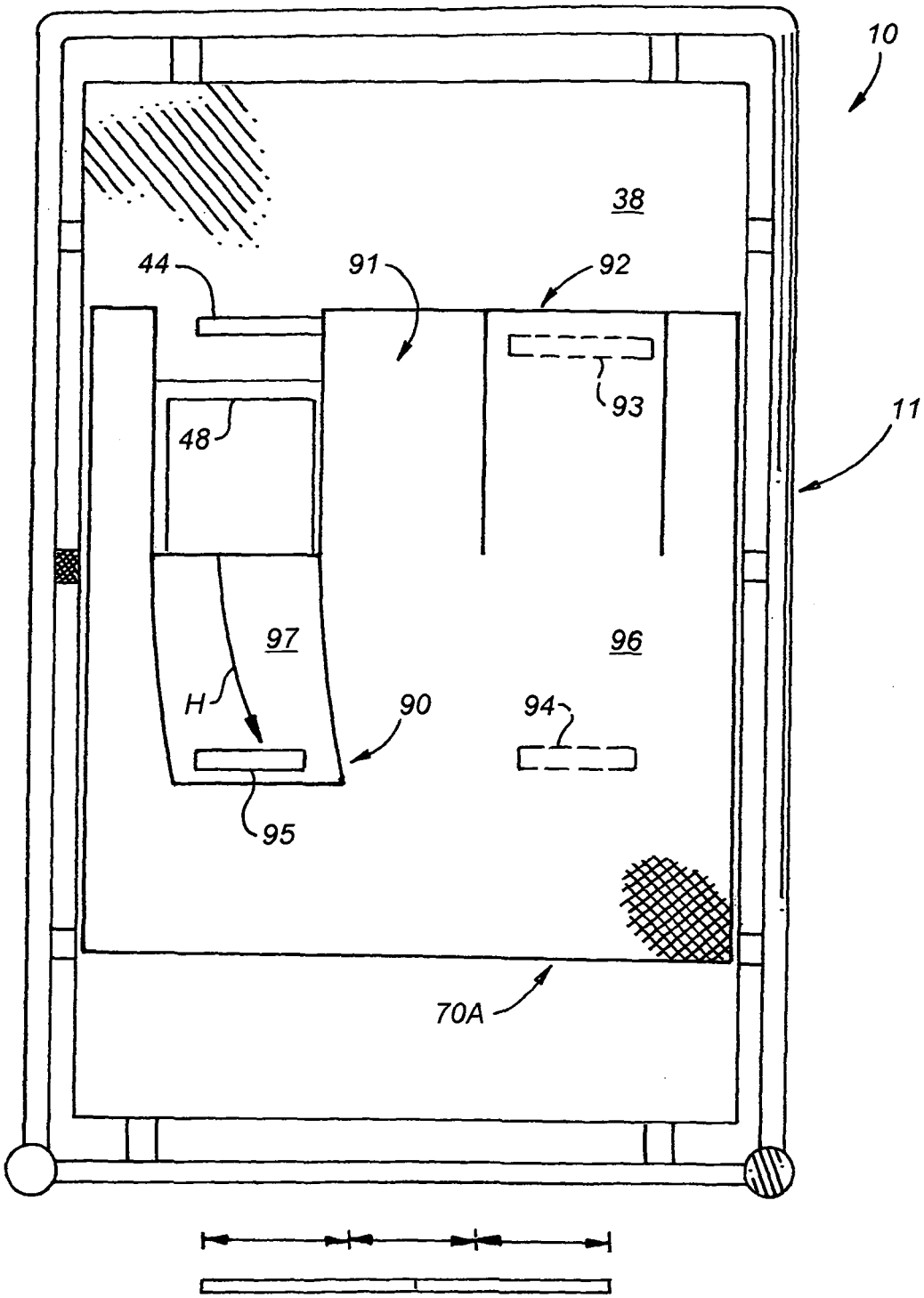
Figure 9:
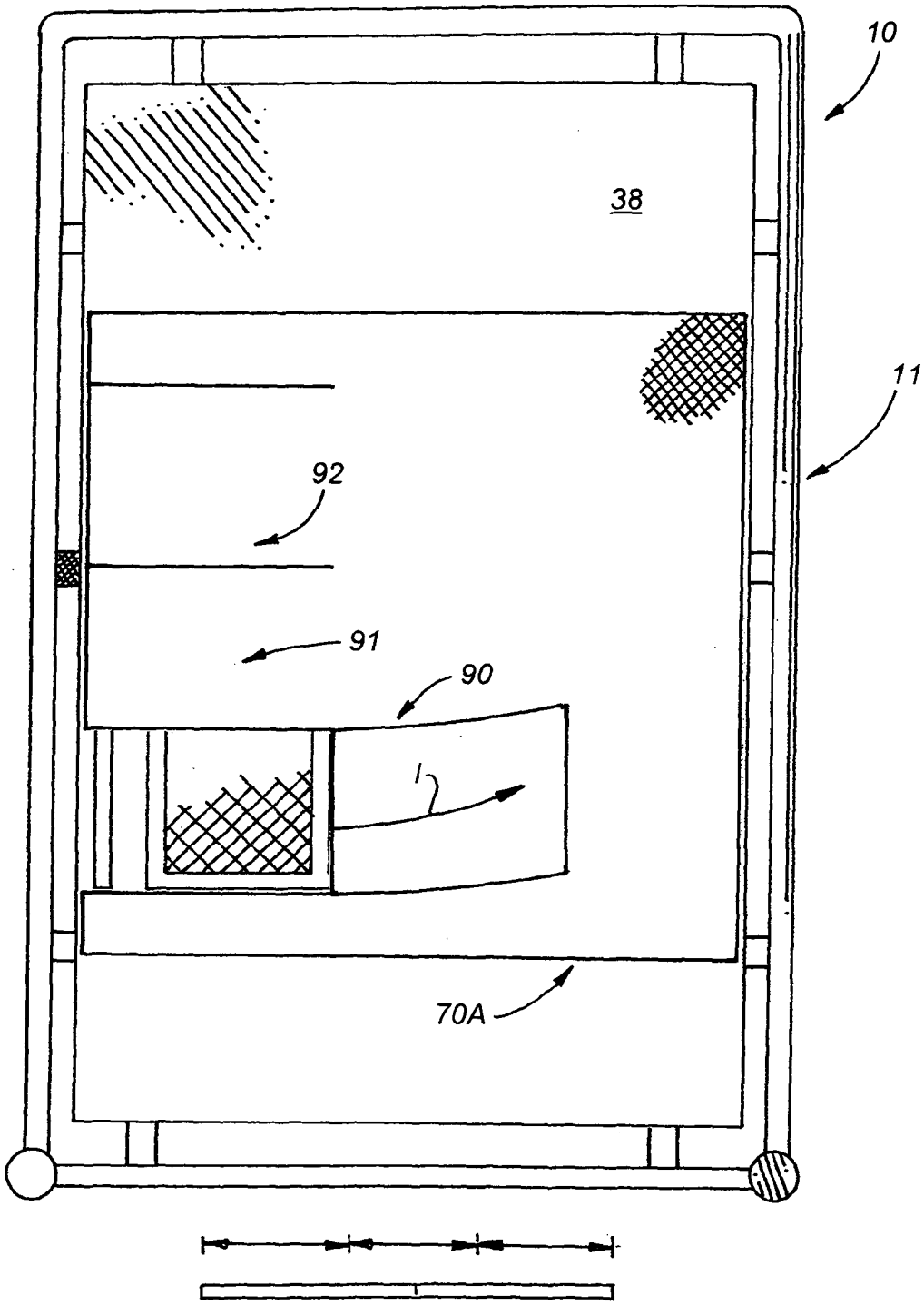

FIGS. 7 to 10 illustrate another embodiment 70A of an auxiliary panel of canvas, polymer, or other material is placed on unit 18 to cover portions of openings 48 to 50. Panel 70A, like panel 70, includes strips of VELCRO fastening material are permanently secured to the back of panel 70A. Each strip removably attaches to at least a portion of an opposing strip 44 to 47, on unit 18. Panel 70A includes three flaps 90 to 92. In FIG. 7 only flap 90 is folded to the left (in the direction of arrow G) to expose the upper part of opening 50. The remainder of opening 50, along with openings 48 and 49, is covered by panel 70A. The configuration of panel 70A in FIG. 7 permits a pitcher to practice throwing baseballs into the upper portion of opening 50. If desired, flap 91 can also, in FIG. 7, be opened and folded to the left to expose the central portion of opening 50; or, flap 92 can be opened and folded to the left to expose the lower portion of opening 50. In FIG. 7, panel 70A is mounted on panel 38 such that flaps 90 to 92 are on the right hand side of panel 38. In FIG. 8, panel 70A is mounted on panel 38 such that flaps 90 to 92 extend across the upper middle portion of panel 38. In FIG. 9, panel 70A is mounted on panel 38 such that flaps 90 to 92 extend along the left hand side of panel 38. And, in FIG. 10, panel 70A is mounted on panel 38 such that flaps 90 to 92 extend across the lower middle portion of panel 38.

Figure 10:
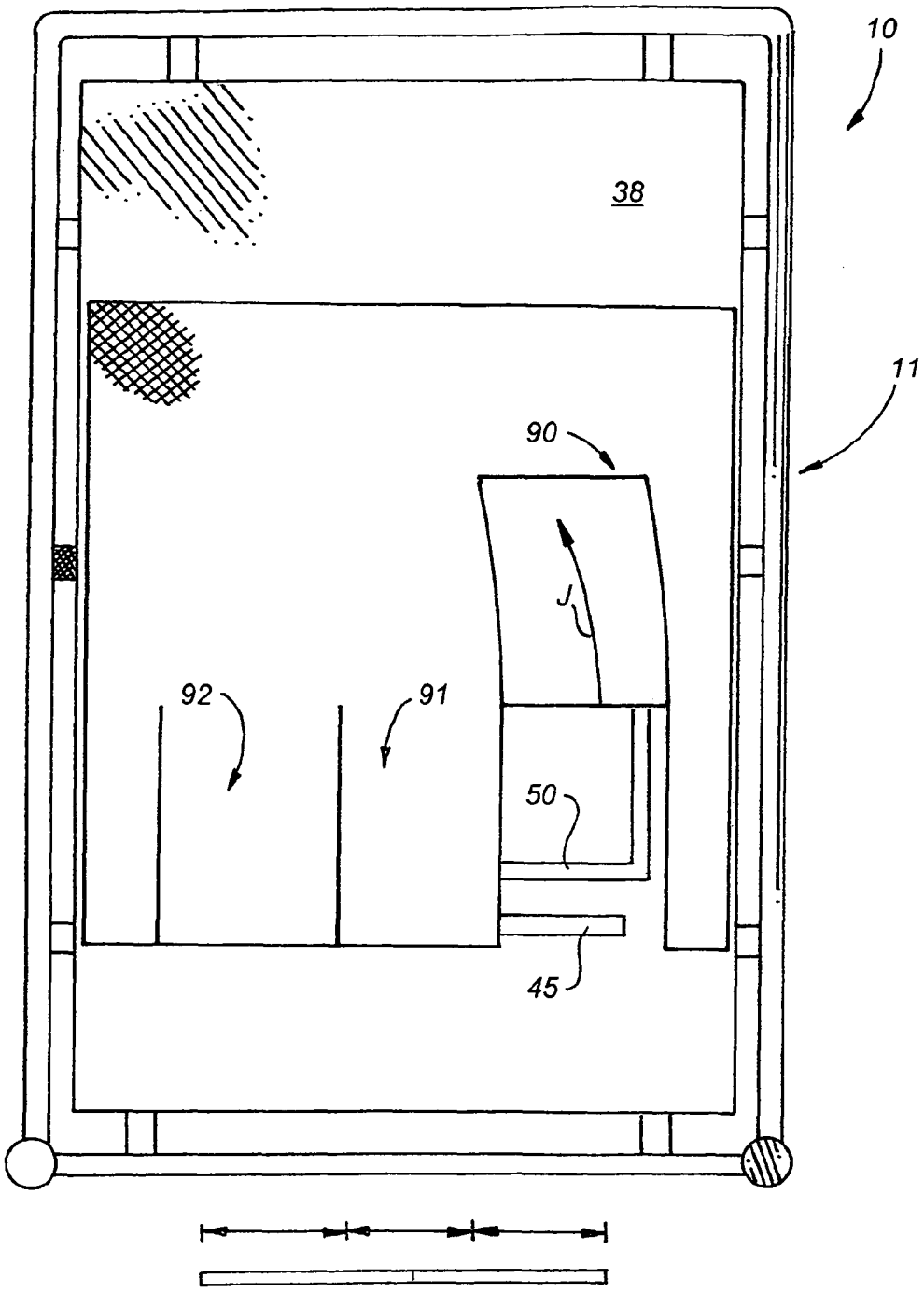

In FIG. 8, only panel 90 is opened to expose the upper portion of opening 48. In FIG. 9, only panel 90 is opened to expose the lower portion of opening 48. In FIG. 10, only panel 90 is opened to expose the lower portion of opening 50.

As would be appreciated by those of skill in the art, if in FIG. 8 panel 91 is opened by downwardly folding panel 91, the upper portion of opening 49 is exposed. If panel 92 is opened by downwardly folding panel 92, the upper portion of opening 50 is exposed. Velcro fastener strips 92 and 93 can be fixedly secured to the outer surface 96 of panel 70A (which outer surface includes the outer surface of panels 90 to 92) so that when panel 92 is opened, strips 92 and 93 are adjacent and contact one another and releasably hold the distal end of panel 92 in place. Similarly, in FIG. 8 VELCRO fastener strips (not visible) on the inside surface 97 of panel 70A (which inside surface includes the inside surface of panels 90 to 92) at the distal ends of panels 91 and 92 secure panels 91 and 92 to VELCRO fastening strip 44 on panel 38. Strip 95 on the inside surface 97 of panel 70A secures the distal end of panel 90 to strip 44 when panel 90 is closed. In FIG. 8 panel 90 is open and panels 91 and 92 are closed.

If in FIG. 9, panel 92 is opened by upwardly folding panel 92, the lower portion of opening 48 is exposed, and so on.

A panel 70A can have any desired number of flaps each of any desired shape and dimension to cover and expose desired portions of openings 48 to 50, or multiple panels can be utilized.

In the drawings, openings 48 to 50 each have longitudinal center lines that extend vertically and openings 48 to 50 are side-by-side. Openings 48 to 50 can be formed through panel 38 to have longitudinal center lines that extend horizontally such that openings 48 to 50 are "stacked" one-on-top of the other; i.e., the size and orientation of each opening 48 to 50 can vary as desired. Each opening need not be the same size as the other openings.

Having described my invention in such terms as to enable those of skill in the art to make and practice it, and having described the presently preferred embodiments thereof,

I claim:

1. A method for practicing pitching a baseball, comprising the steps of (a) providing apparatus comprising (i) an upright support, (ii) a strike zone parsing panel (38) mounted on said support and including a fixed rectangular target opening including four corners and defining a virtual strike zone that has an effective combined width that is greater than the width of a regulation home plate, said fixed target opening comprising at least four separate corner openings at said corners of said rectangular target opening, said four corner openings including a first upper corner opening, a second upper corner opening located laterally from said first upper corner opening, a first lower corner opening located beneath said first upper corner, and a second lower corner opening located beneath said second upper corner, (iii) a shielding system comprising a panel member (70A)

detachably mountable on said parsing panel (38) to cover selectively three of said four corner openings while uncovering the remaining one of said four corner openings, and rotatable on said parsing panel (38) between at least two operative positions, a first operative position in which said panel member (70A) uncovers a selected one of said upper corner openings and covers the remaining one of said upper corner openings and said lower corner openings, and a second operative position reached by turning said panel member (70A) from said first operative position and in which said panel member (70A) uncovers a selected one of said lower corner openings and covers the remaining ones of said lower corners openings and said upper corner openings;

(b) selecting one of said upper corner openings;

(c) mounting said panel member (70A) on said parsing panel (38) in said first operative position to uncover said selected one of said upper corner openings and to cover the remaining ones of said four corner openings;

(d) throwing pitches toward said selected one of said upper corner openings;

(e) selecting said selected one of said lower corner openings;

(f) rotating said panel member from said first to said second operative position, and mounting said panel member (70A) on said parsing panel (38) in said second operative position to uncover said selected one of said lower corner openings and to cover the remaining ones of said four corner openings; and, (g) throwing pitches toward said selected one of said lower corner openings.

2. The method of claim 1 wherein said combined width of said virtual strike zone is in the range of eighteen to twenty-eight inches.

* * * * *